US012427392B2

(12) United States Patent
Sadler

(10) Patent No.: US 12,427,392 B2
(45) Date of Patent: Sep. 30, 2025

(54) GOLF TRAINING AID

(71) Applicant: Andrew Sadler, Bexleyheath (GB)

(72) Inventor: Andrew Sadler, Bexleyheath (GB)

( * ) Notice: Subject to any disclaimer, the term of this patent is extended or adjusted under 35 U.S.C. 154(b) by 309 days.

(21) Appl. No.: 18/299,853

(22) Filed: Apr. 13, 2023

(65) Prior Publication Data

US 2023/0330504 A1 Oct. 19, 2023

(30) Foreign Application Priority Data

Apr. 14, 2022 (GB) ..... 2205603

(51) Int. Cl.
*A63B 69/36* (2006.01)
*A63B 102/32* (2015.01)

(52) U.S. Cl.
CPC ..... *A63B 69/3676* (2013.01); *A63B 2102/32* (2015.10)

(58) Field of Classification Search
CPC ..... A63B 69/3676; A63B 2102/32; A63B 2071/024; A63B 2063/002; A63B 2071/0602; A63B 2071/0694; A63B 2210/50; A63B 2225/09; A63B 57/40; A63B 69/3608; A63B 63/00
USPC ..... 473/179, 180, 185, 219, 257–270
See application file for complete search history.

(56) References Cited

U.S. PATENT DOCUMENTS 2,742,293 A * 4/1956 Davis ..... A63B 71/04 473/188
3,338,579 A * 8/1967 McKain ..... A63B 71/04 273/127 R
3,659,856 A * 5/1972 Fatur ..... A63B 57/357 33/333
6,183,373 B1 2/2001 Falvo
6,482,098 B1 * 11/2002 Yates ..... A63B 57/357 473/185
6,923,730 B1 * 8/2005 Potter ..... A63B 69/3676 473/265
2003/0181252 A1 * 9/2003 Bennett ..... A63B 69/3676 473/162
2007/0259728 A1 * 11/2007 Whitefield ..... A63B 57/40 473/185

(Continued)

FOREIGN PATENT DOCUMENTS

GB 2452034 2/2009
KR 101497477 3/2015

(Continued)

OTHER PUBLICATIONS

Extended European Search Report received for EP Patent Application No. 23168115.6 mailed on Nov. 17, 2024, 14 pages.

(Continued)

*Primary Examiner* — Nini F Legesse
(74) *Attorney, Agent, or Firm* — AEON Law, PLLC; Adam L.K. Philipp; Charlotte E. Holoubek

(57) ABSTRACT

A golf training aid, comprising a ring shaped main body having an inwardly curved arm extending from either side of a central target section, the ends of each arm being separated by a gap to allow a ball, in use, to pass therethrough in order to reach the target section; each arm comprising front and back sections connected by a hinged joint to allow the front section to move relative to the back section thereby to increase or decrease the size of the gap.

10 Claims, 9 Drawing Sheets

(56) References Cited

U.S. PATENT DOCUMENTS

2011/0118041 A1* 5/2011 Lynch ..... A63B 69/3676
473/180

FOREIGN PATENT DOCUMENTS

KR 1020150021241 A 3/2015
WO 2016106539 A1 7/2016

OTHER PUBLICATIONS

Search Report received for GB Patent Application No. 2205603.0, dated Sep. 16, 2022, 1 page.

* cited by examiner

GOLF TRAINING AID

FIELD OF THE INVENTION

The present invention relates to a golf training aid. More particularly the invention relates to a golf training aid to designed to improve putting.

BACKGROUND TO THE INVENTION

It is estimated that 36.9 million people play regular weekly golf around the world.

One of the most important disciplines in golf is putting. Quite often, a hole or even a round, of golf can be ruined by poor putting technique, even if the rest of the play is exemplary.

Often, amateur golfers may offer their playing partners a 'gimmie putt', for a putt so short that it should be unmissable, so it is counted as 'made' without the need for finishing the put. Whilst this can be a relief for players lacking in confidence or ability in making these shots, it can be detrimental to the player as the player does not get to practice what should be considered the easier putting shots.

The present invention seeks to provide a golf putting aid that can be used away from the golf course to improve the putting technique and skill of a golfer. The device avoids the need for a hole to practice a put and, as such, can be used in any area with the required surface space.

SUMMARY OF THE INVENTION

According to a first aspect of the invention, there is provided a golf training aid, comprising:

- a ring shaped main body having an inwardly curved arm extending from either side of a central target section, the ends of each arm being separated by a gap to allow a ball, in use, to pass therethrough in order to reach the target section;
- each arm comprising front and back sections connected by a hinged joint to allow the front section to move relative to the back section thereby to increase or decrease the size of the gap.

Preferably, the front and back sections of each arm are separable at the hinged joint to allow an alternative front section to be secured to the back section.

Preferably, the front section has an angled end surface.

Preferably, the end surface is bevelled.

Preferably, the front section has a substantially vertical front surface.

Preferably, the hinged joint is located approximately two thirds along the length of the arm from the back section.

Preferably, the central target section includes a visible shaped protrusion.

Preferably, the protrusion is X-shaped.

Preferably, the underside of the base of the main body has at least one downwardly extending grip member.

Preferably, the upper surface of each arm has at least one circular recess.

BRIEF DESCRIPTION OF THE DRAWINGS

Embodiments of the invention will now be described by way of example only with reference to the accompanying drawings in which.

DETAILED DESCRIPTION OF THE INVENTION

Figure 1B:
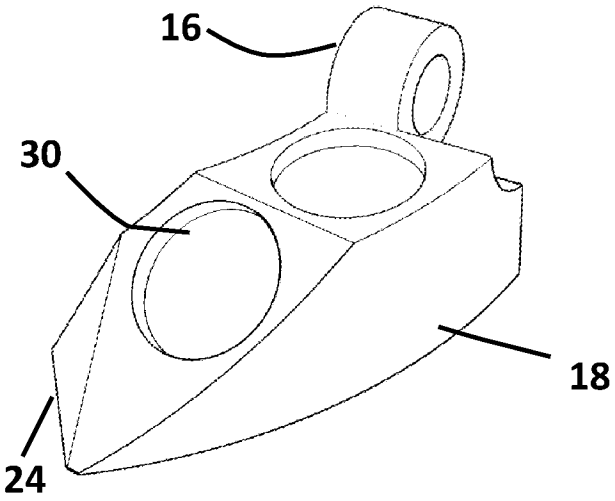
FIG. 1B is a perspective view of the interchangeable arm in accordance with a first embodiment of the invention.
Figure 1A:
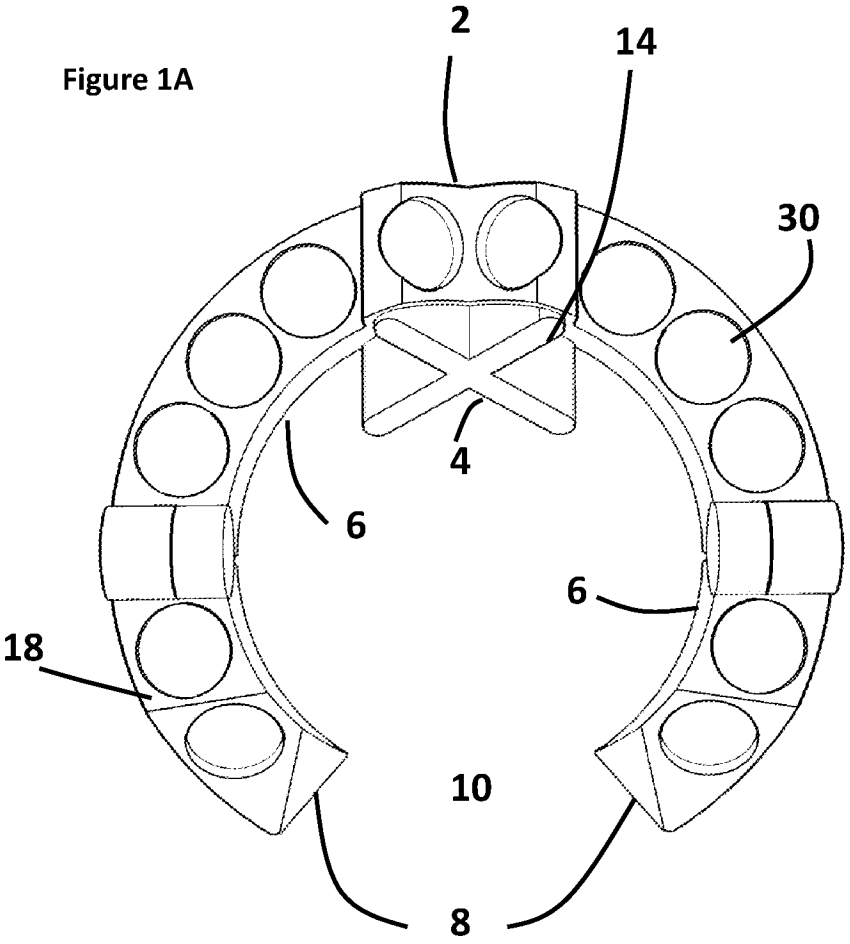
FIG. 1A is a perspective view of the putting ring in accordance with a first embodiment of the invention.

FIG. 1A illustrates a golf training aid constructed in accordance with a first embodiment of the invention. The aid takes the general form of a putting ring having a main body 2 formed as a partial circle or horseshoe shape. The main body 2 includes a central alignment target section 4 either side of which extends an inwardly curved arm 6. The arms 6 curve inwardly towards each other to form the horseshoe shape. The tips 8 of each arm are separated from each other to provide an opening 10 through which a golf ball 12 can be struck with the intention of hitting the target section 4. To this end, the target section 4 includes a visible shaped protrusion 14 extending outwardly from its inner surface to provide a visible target for the golfer whilst practicing putting. The X-shaped protrusion provides a three-dimensional target to the user on a raised surface so that it is more visible to the eye, making for an enhanced alignment target.

Figure 5:
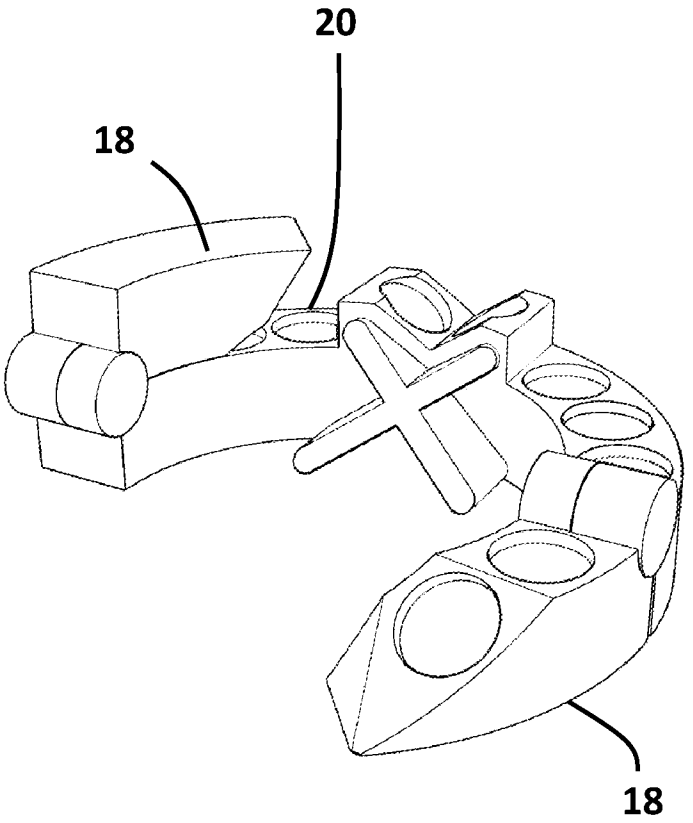
FIG. 5 is a perspective view of the putting ring with one retractable arm.

Each arm 6 has a hinged joint 16 approximately two thirds along its length to allow an end section 18 of each arm 6 to be hinged upwardly and back onto the back section 20 to thereby increase the opening 10 allowing for a simpler or longer putt (see FIG. 5).

The hinged joint 16 provides for incremental adjustment of the relative angle of the back and end section 20,18 of each arm 6 to accommodate an uneven floor surface if for example the training aid is used on a carpet pile or grass.

Figure 2:
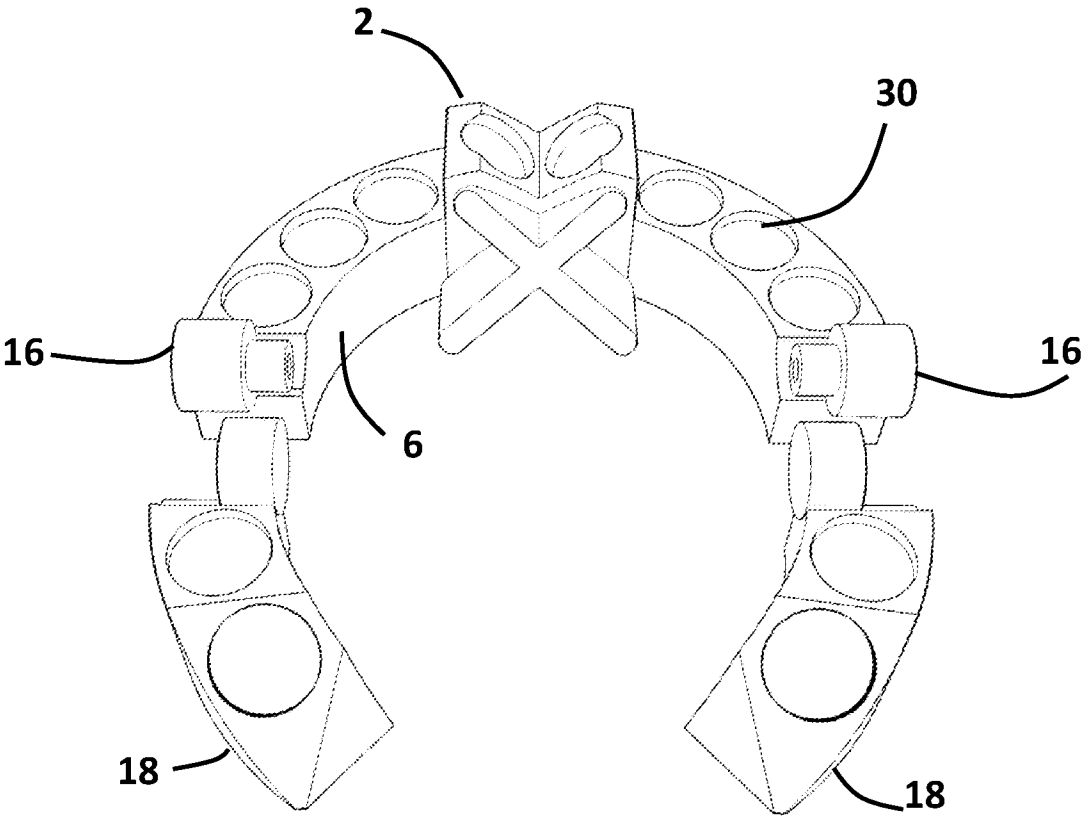
FIG. 2 is an exploded view of the hinged joint of the putting ring.
Figure 3:
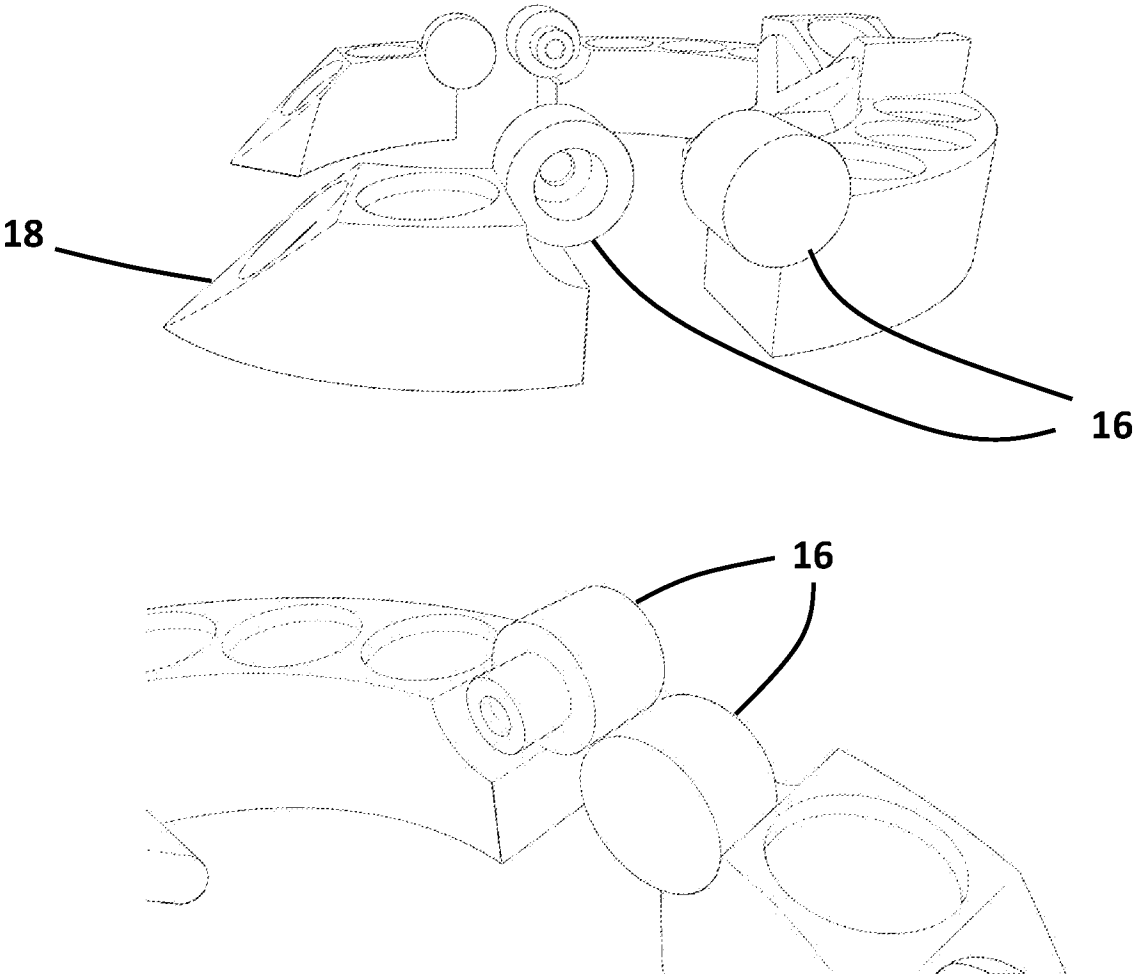
FIG. 3 is an exploded side view of the hinged joint of the putting ring.
Figure 4:
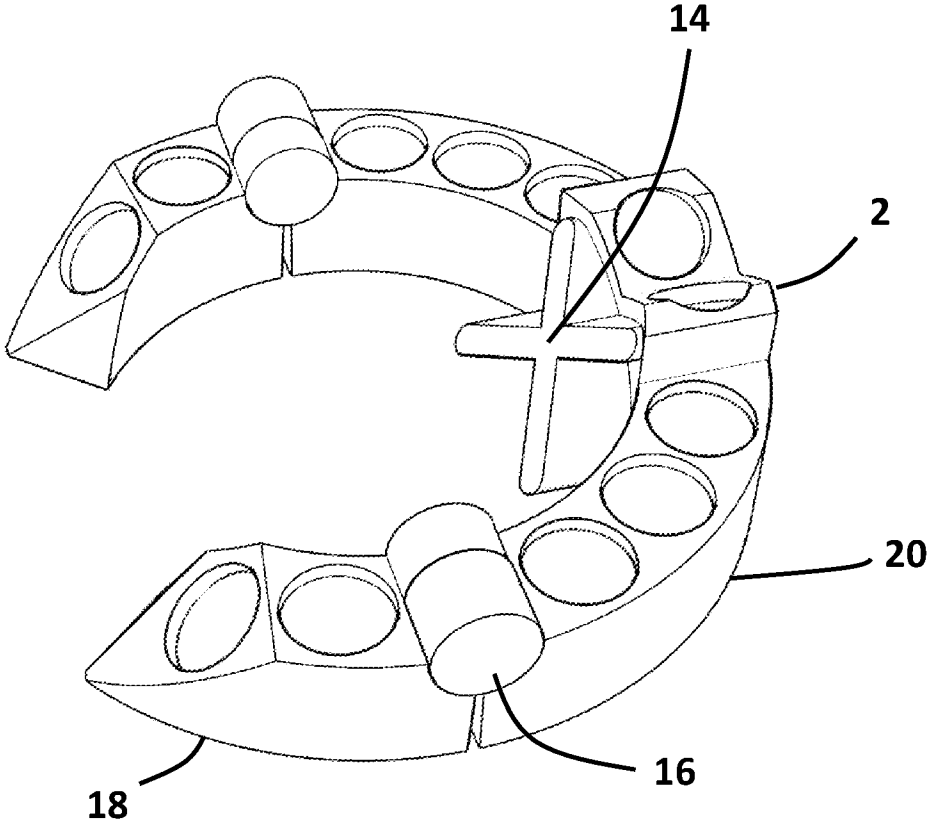
FIG. 4 is a side view of the putting ring in accordance with a first embodiment of the invention.
Figure 6B:
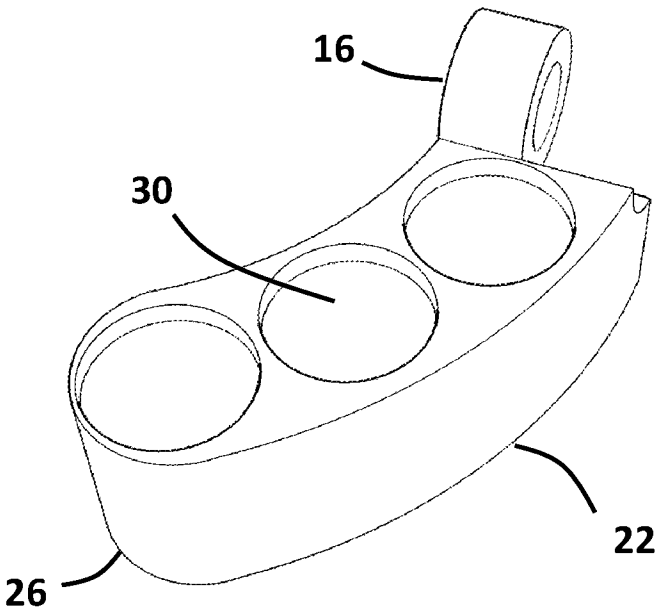
FIG. 6B is a perspective view of the interchangeable arm in accordance with a second embodiment of the invention.
Figure 6A:
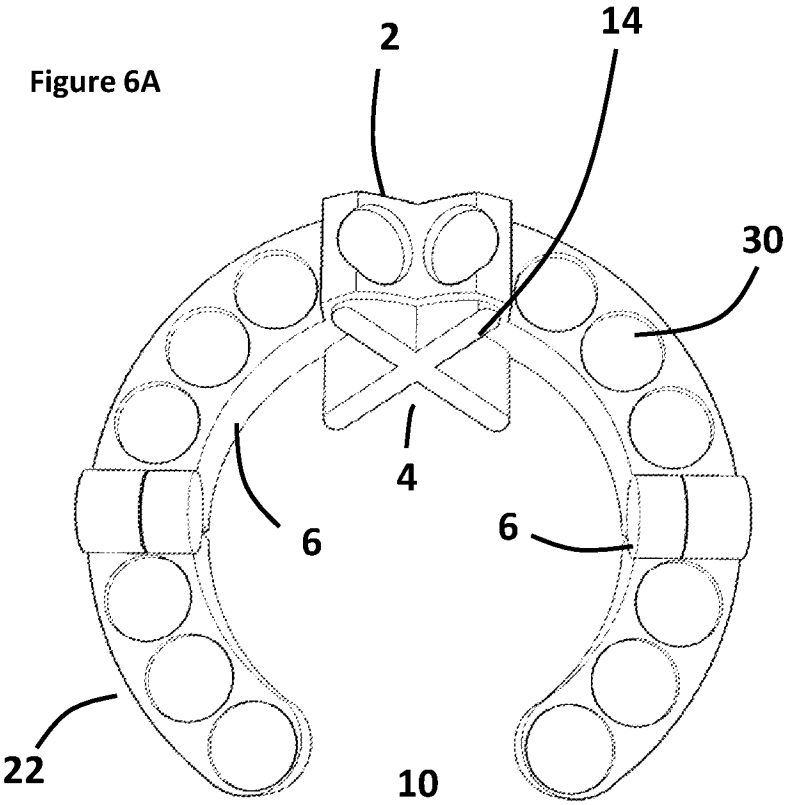
FIG. 6A is a perspective view of the putting ring in accordance with a second embodiment of the invention.
Figure 7:
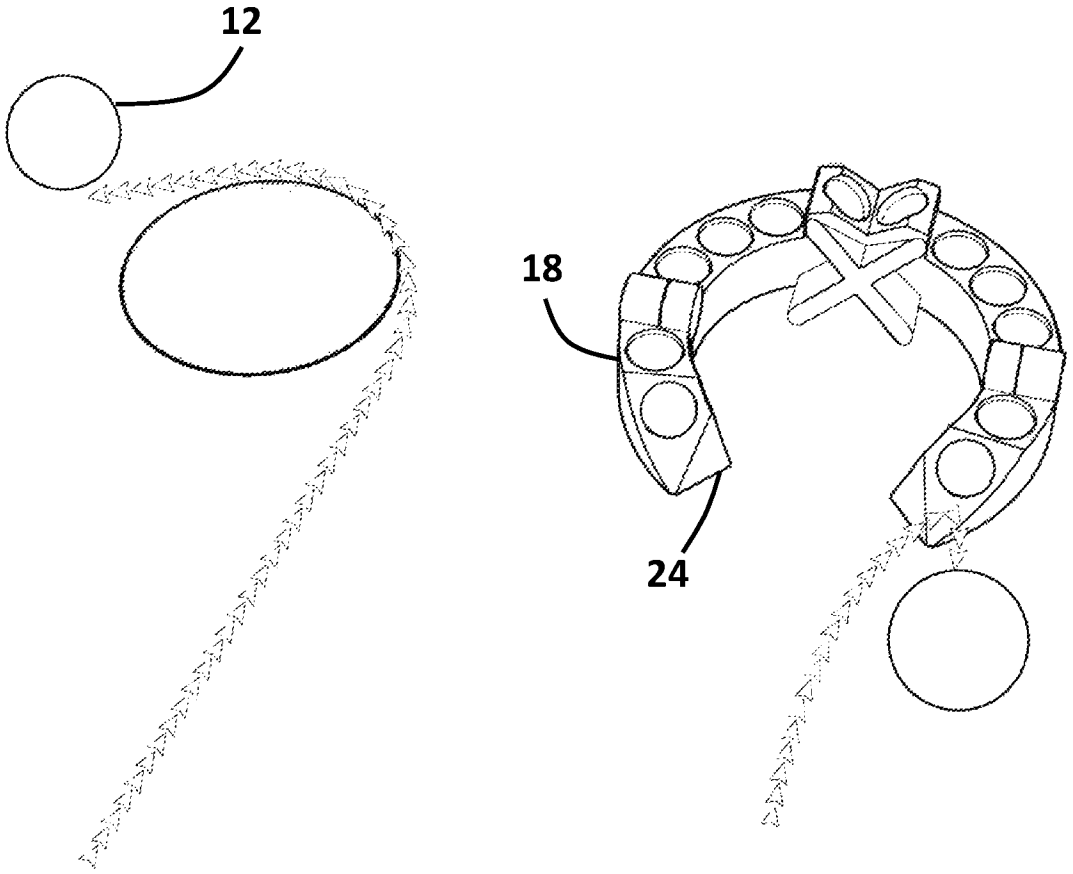
FIG. 7 is a perspective view of the 'lip out' feature on the putting ring in accordance with this invention.
Figure 8:
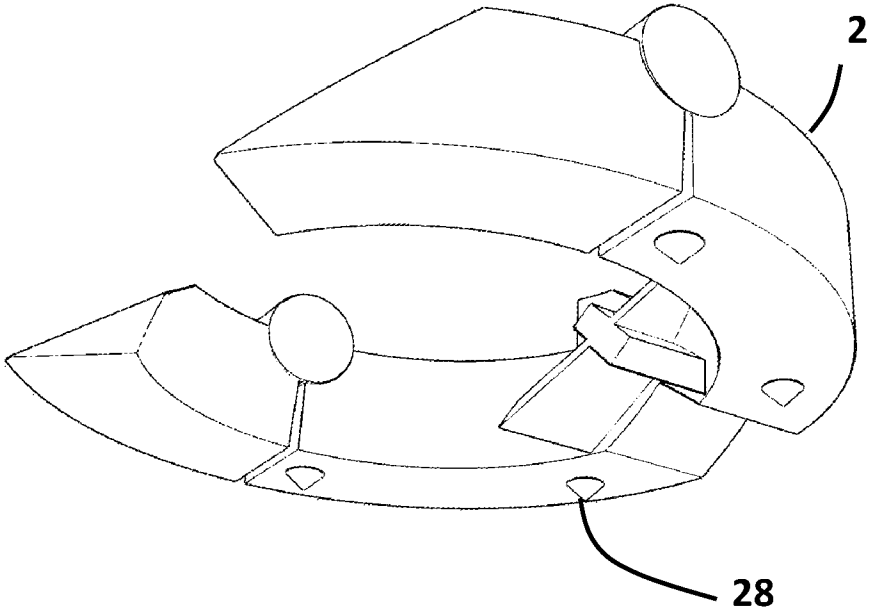
FIG. 8 is a base view of the spikes on the putting ring in accordance with this invention.
Figure 9:
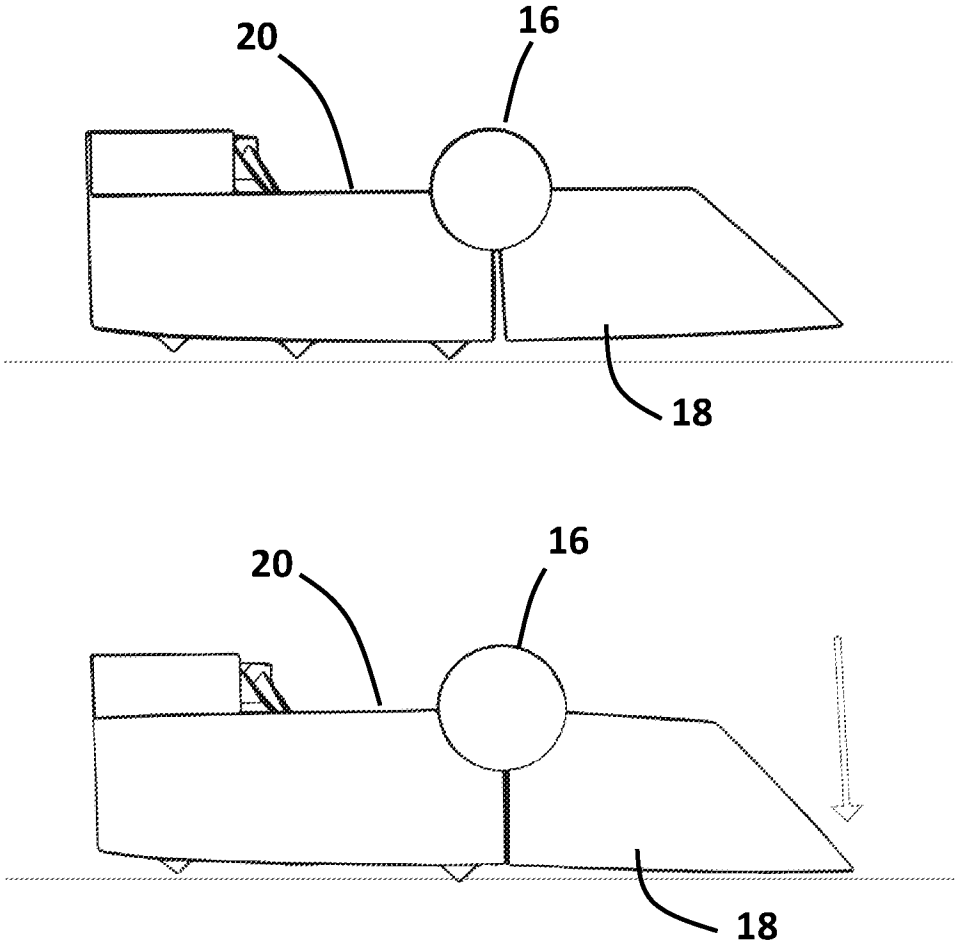
FIG. 9 is a side view of the putting ring when the angle of elevation has been altered.

As can be seen in FIGS. 2 and 3, the joint 16 may be formed into two separable halves to allow for disconnection of the end section 18 and replacement of an alternatively shaped end section, such as an end section 22 shown in a second embodiment of FIG. 6B.

It can be seen from the FIGS. 1A-1B and 6A-6B that end sections 18, 22 have a differently shaped end surface 24, 26 which provide for different trajectory of the golf ball 12 on impact.

The end section 18 of a first embodiment has a bevelled end surface 24. The angle of the edge simulates what is commonly known in golf as a 'lip out' effect, where the golf ball travels around the circumference of the hole and not drop to it. Alternative end sections 18 may provide bevelled end surfaces of different angles to change the likelihood of lip-out.

The end section 22 of the second embodiment has a vertical end surface 26 that is not angulated. This creates a smaller target opening 10 with less margin for error and a golf ball impacting the end surface 26 will repel away from the target section 4.

Alternatively, many variations of angles could be present on the edge of the interchangeable arms.

The underside of the base of the main body 2 includes downwardly extending grip members wherein a plurality of spikes 28 provide grip and stability onto the surface of which the ring is placed which could for example be artificial grass. The grips prevent the training aid from moving when impacted by a golf ball during use on putts hit with greater force. Preferably there are six spikes 28 evenly spaced along the underside of the base of the ring, however any number of spikes 28 may be used.

Typically, the circumference of the putting ring is approximately 108 mm, in line with the Professional Golfers' Association and the United States Golf Association Hole measurements. The distance from the end of each arm 6 is approximately 67 mm to accommodate at least one standard golf ball of size 42.67 mm. It will be appreciated though that these sizes can vary and be easily altered to accommodate different sized balls.

The main body 2, including the arms 6, and the tips 18, 22 include circular recesses 30 in their upper surface. The recesses 30 are designed to illude the user as to size of the opening 10. A golf ball placed in the centre of the putting ring, surrounded by smaller stimuli, will appear much larger than it is. This illusion is known as the Ebbinghaus Optical Illusion and is thought to improve performance of the putter.

Preferably, the putting ring is injection moulded from recycled plastics to reduce impact on the environment however can equally be made of any other materials.

The invention claimed is:

1. A golf training aid comprising:

a ring shaped main body having an inwardly curved arm extending from either side of a central target section, each inwardly curved arm having a distal end; wherein the respective distal ends are separated by a gap of a size to allow a ball, in use, to pass therethrough in order to reach the central target section; and each inwardly curved arm comprising a front arm section and a back arm section connected by a hinge;

wherein, each front arm section is configured to be adjusted incrementally, via the hinge, upwardly and back relative to the back arm section; whereby the adjustment allows for an increase or decrease in the size of the gap and to accommodate the golf training aid on an uneven floor surface.

2. The golf training aid of claim 1, wherein the front arm section and back arm section of each arm are separable at the hinged joint to allow an alternative front arm section to be secured to the back section, respectively.

3. The golf training aid of claim 2, wherein the front arm section has an angled end surface.

4. The golf training aid of claim 3, wherein the angled end surface is bevelled.

5. The golf training aid of claim 2, wherein the front arm section has a substantially vertical front surface.

6. The golf training aid of claim 1, wherein the hinged joint is located approximately two thirds along a length of the arm from the back arm section.

7. The golf training aid of claim 1, wherein the central target section includes a visible shaped protrusion.

8. The golf training aid of claim 7, wherein the shaped protrusion is X-shaped.

9. A golf training aid according to claim 1, wherein an underside of a base of the main body has at least one downwardly extending grip member.

10. The golf training aid of claim 1, wherein an upper surface of each inwardly curved arm has at least one circular recess.

* * * * *